United States Patent [19]

Burgess

[11] 4,032,117

[45] June 28, 1977

[54] PASTE MIXER

[75] Inventor: Basil Arthur Burgess, Montreal, Canada

[73] Assignee: Bowers Machine Company Limited, Canada

[22] Filed: Sept. 15, 1975

[21] Appl. No.: 613,406

[30] Foreign Application Priority Data

Oct. 25, 1974 Canada ..... 212279

[52] U.S. Cl. ..... 259/108; 259/122

[51] Int. Cl.[2] ..... B01F 7/24

[58] Field of Search ..... 259/108, DIG. 30, DIG. 9, 259/DIG. 1, DIG. 7, DIG. 12, DIG. 13, DIG. 38, 105, 121, 122, 120, 118, 119, 107, 103, 106, 6, 7, 8, 23, 24, 43, 44

[56] References Cited

UNITED STATES PATENTS

| | | | |
|---|---|---|---|
| 1,153,246 | 9/1915 | Noggle | 259/108 |
| 2,102,054 | 12/1937 | Billings et al. | 259/105 |
| 2,122,187 | 6/1938 | Vollrath | 259/105 |
| 2,517,149 | 8/1950 | Walsh et al. | 259/108 |
| 2,778,922 | 1/1957 | Birkner, Jr. | 259/108 UX |
| 2,882,149 | 4/1959 | Willems | 259/108 X |
| 3,249,342 | 5/1966 | Mikkelsen | 259/108 |

*Primary Examiner*—Robert W. Jenkins
*Attorney, Agent, or Firm*—Larson, Taylor and Hinds

[57] ABSTRACT

A mixing machine having spirally intermeshed assemblies of fixed baffles and rotating blades. The fixed baffles, at least, are of semi-cylindrical helical form and are each set on a crossbar so as to project in alternate semi-circular arrangement on opposite sides of the crossbar and each is in spaced radial relation to an adjacent blade of the rotor blade assembly. The free ends of both the baffles and rotor blades overlap the fixed adjacent ends of the baffles and rotor blades so that in their intermeshed arrangement, the rotor blades sweep through enclosed circular paths between adjacent baffles.

5 Claims, 11 Drawing Figures

PASTE MIXER

This invention relates to mixing machines and particularly to machines for mixing materials to which shear is applied continuously to the material during the mixing operation.

In mixing machines heretofore used, the practice has been to use a combination of stationary baffles, and rotating blades disposed between the stationary baffles and parallel therewith. Such a combination of baffles and blades applies shear only to the material as the rotating blades pass between the stationary baffles and the amount of shear applied to the material being mixed is dependent on the clearance between the stationary baffles and the rotating blades. The closer the clearance the greater the shear.

The shear applied to the material occurs only twice during each revolution of the rotating blades as the blades pass between the baffles. Furthermore, the amount of shear per revolution is a function of the length of the baffles and blades and as the intermeshing blades and baffles are all vertical, they provide a minimum of shear.

If any reasonable degree of shear is developed at the intermeshing position of the blades with the baffles, the power required to turn the blades through the fixed baffles can be several times that required to move the blades in unbaffled areas of the tank. This results in two peak or shock loads on the drive mechanism during each revolution.

Furthermore, as axial (vertical) motion in the batch of material being mixed is at a minimum due to the parallel alignment of the baffles and blades, it is often necessary to run the mixing machine for prolonged periods in order to eliminate stratification and produce a homogeneous mix.

In the present invention, there is provided intermeshing assemblies of fixed baffles and rotating blades in which at least the fixed baffles are of partial helical form in order that, on rotation of the blades, the blades of the rotating blade assembly are in constant spiral intermesh with the fixed baffles. This constant spiral intermesh between baffles and blades ensures that the material being mixed is subject to constant shear and axial and radial motion and stratification of the material is eliminated. As the length of a spiral blade or baffle is much greater than the conventional straight vertical units, the amount of shear applied to the batch per blade per revolution is correspondingly greater. Also, due to the constant spiral intermesh between baffles and blades, the load on the drive mechanism of the machine is constant, resulting in the complete mixing of material in a minimum of time with greatly reduced power consumption.

In a preferred form of the invention, the fixed baffles are of semi-circular helical form whose upper ends are fixed to a crossbar located under the top plate or cover of the mixing tank. These baffles are alternately disposed on either side of the crossbar on which they are mounted and together form concentric semicircles radially spaced apart about the axis of the drive shaft of the machine, with the ends of the semi-circular baffles overlapping to form, in plan view, closed concentric circles.

In this preferred form of the invention, the rotor blades are also of partial helical form and are mounted at their lower ends to a crossbar secured to the lower end of the drive shaft, and project upwards and intermesh with the helical form baffles to make continuous spiral intermesh with the baffles when the drive shaft is rotated.

In an alternative form of the invention, the rotor blades are straight bars projecting upwardly from the crossbar secured to the lower end of the drive shaft and intermesh with the fixed helical form baffles.

Each of the partial helical form baffles and blades form a semi-circle of slightly over 180° when seen in plan view. Each baffle or blade in the assembly is of greater radius than the adjacent inner one and together form concentric spaced apart semi-circles about the axis of the drive shaft of the machine, with the free ends of each baffle or blade overlapping the ends which are secured to the crossbar when seen in plan view.

The number and spacing of the rotor blades is such that with respect to the axis of the drive shaft, the rotor blades will be located between the baffles when they are intermeshed.

It is, therefore, a primary object of the invention to provide means whereby maximum shear is provided to the material to be mixed in a mixing machine.

It is a further object of the invention to provide a degree of flexibility to both the fixed baffles and the rotary blades in a mixing machine so that the baffles and blades will be in constant spiral intermesh with each other during the mixing operation.

It is a further object of the invention to provide an intermeshed fixed baffle assembly and rotary blade assembly in a mixing machine which will combine to effect both axial and radial flow to the material being mixed and thus eliminate stratification of the material.

These and other objects of the invention will be apparent from the following detailed specification and the accompanying drawings, in which.

Figure 8:
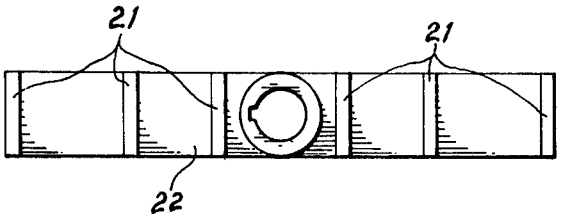
FIG. 8 is a plan view similar to FIG. 6, but showing a rotor with straight blades.
Figure 8A:
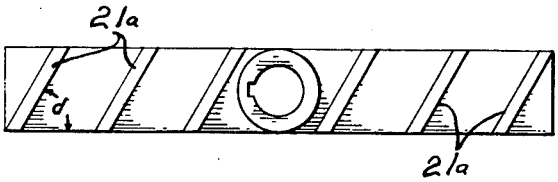

FIG. 8*a* is similar to FIG. 8, but showing the blades set at an angle.

Figure 3:
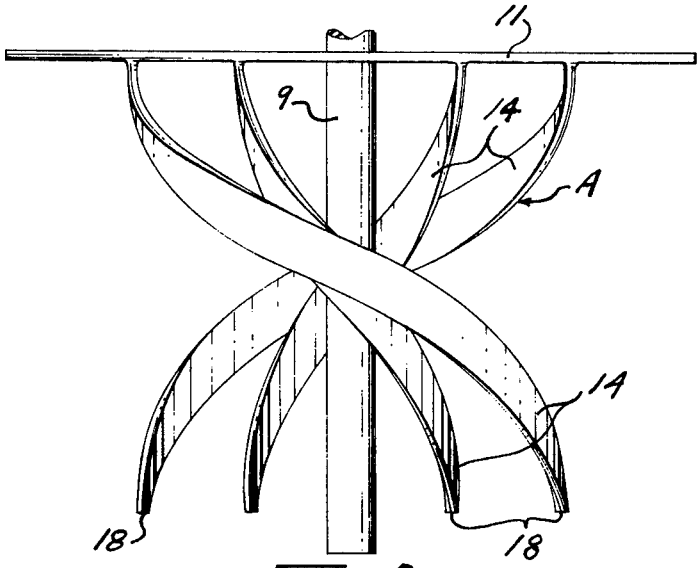
FIG. 3 is an elevational view of the fixed baffle assembly only, taken from FIG. 2.
Figure 9:
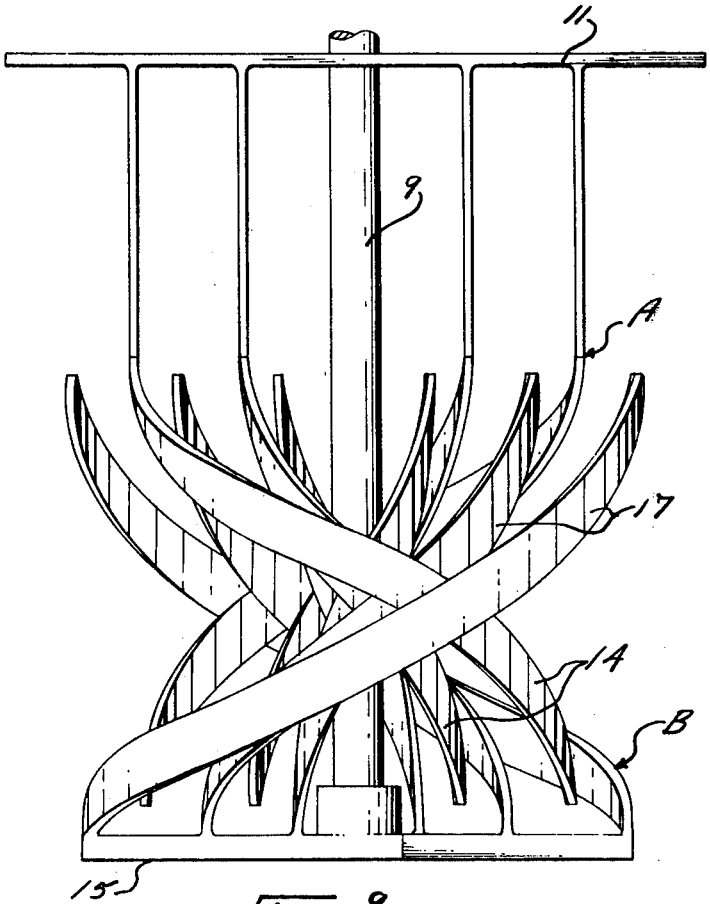

FIG. 9 is a view similar to FIG. 3, but showing a modified arrangement of the baffles.

Figure 10:
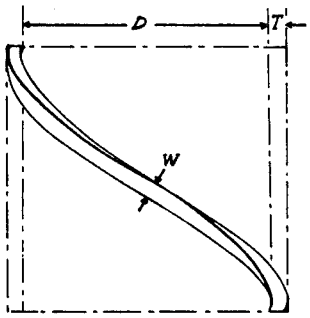

FIG. 10 is a front elevation of a curved baffle and/or blade, as shown in any of FIGS. 1 to 6.

Referring to the drawings, the mixing machine in which the present invention forms an integral part consists of a tank 5 generally fitted with a material charging opening, not shown, in a top wall 7 and a slide discharge gate or a valve 8 at the bottom of the tank 5.

A drive shaft 9 is axially aligned within the tank 5 through a suitable bearing in the top wall 7 and is rotated by an external drive mechanism 10 in well known manner.

A fixed baffle assembly A consists of a crossbar 11 forming a part of the top wall 7 of the tank 5 and includes a central bearing 13 supporting the upper end of the drive shaft 9.

In some instances, the drive mechanism 10 may be mounted on the underside of the tank 5.

The baffle assembly A is here shown as having four baffles 14. These baffles 14 are of semi-cylindrical helical form, as shown in detail in FIGS. 3 and 5, and are secured at their upper ends to the under surface of the crossbar 11 by welding or other suitable means.

Figure 5:
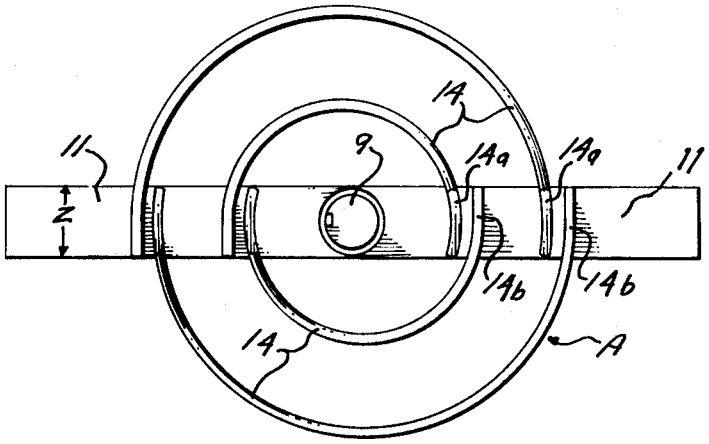
FIG. 5 is a bottom plan view of the assembly shown in FIG. 3.
Figure 6:
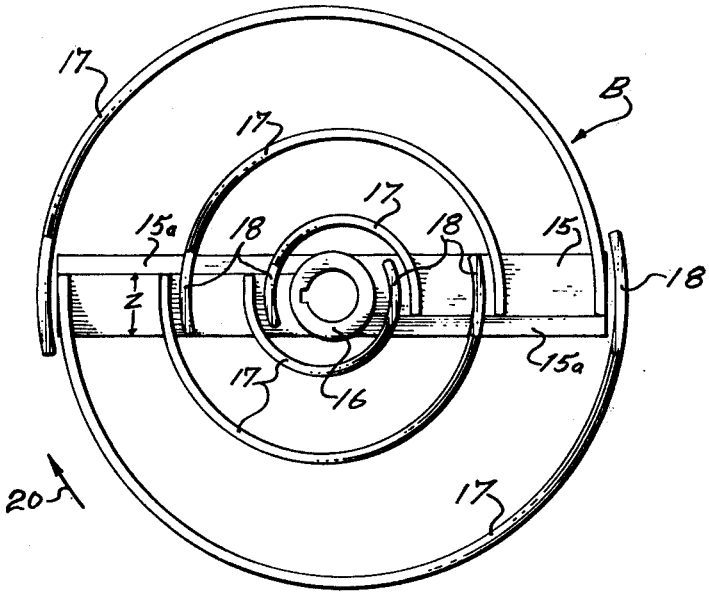
FIG. 6 is a plan view of the assembly shown in FIG. 4.

The baffles 14 are alternately set to project radially outwards of the axis of the drive shaft 9 on opposite sides of the crossbar 11 in alternate concentric semi-circular arrangement and in such a manner that when seen in plan view, the free ends 14*a* of the baffles overlap the fixed ends 14*b* of adjacent baffles but in spaced relation thereto, as is shown in FIGS. 5 and 6.

The rotor blade assembly B consists of a crossbar 15 which has a centrally located boss 16 on its upper surface. The lower end portion of the drive shaft 9 is non-rotatably secured in the boss 16 by means of a key or other suitable means.

Figure 1:
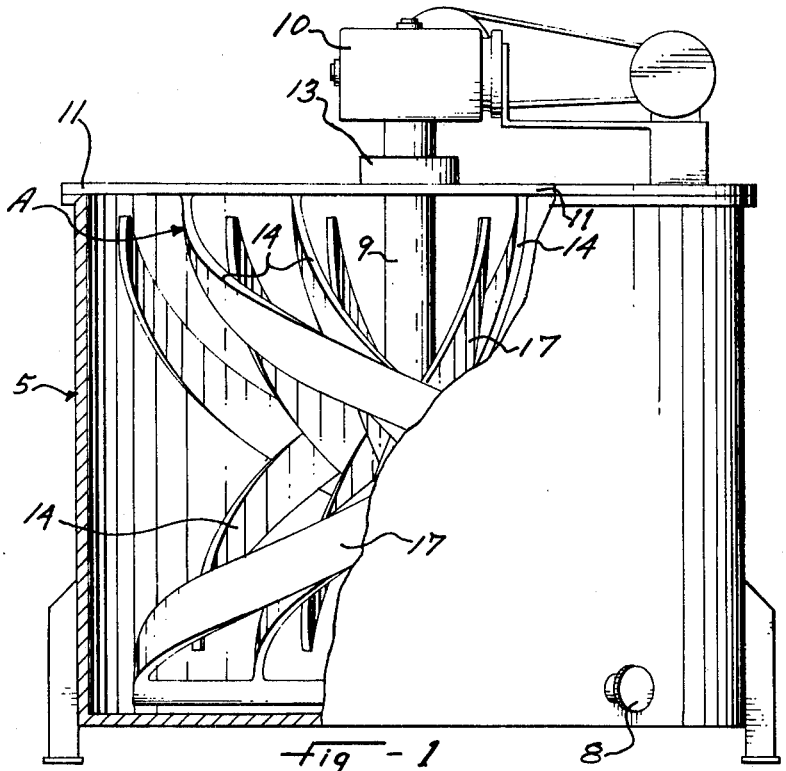
FIG. 1 is a partial sectional elevation of a mixing machine according to the present invention.
Figure 2:
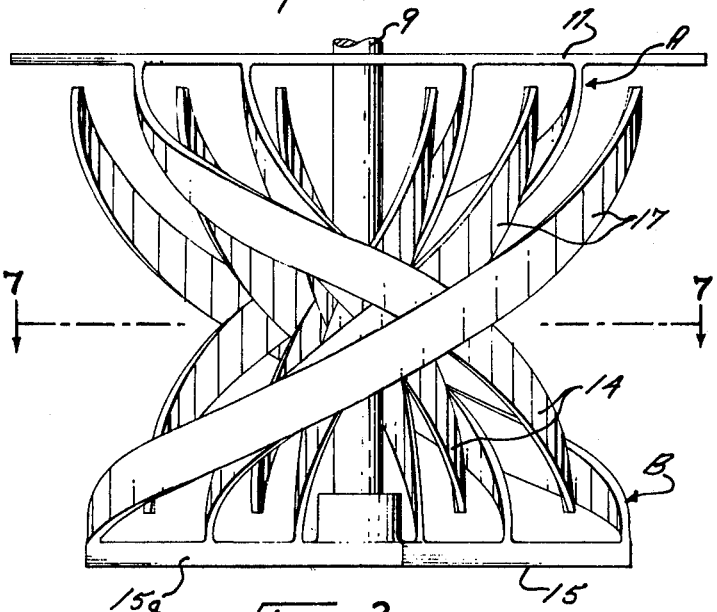
FIG. 2 is an enlarged elevational view of the mixing element as shown in FIG. 1.

The rotor blades 17 are here shown as six in number and are of semi-cylindrical helical form similar to the baffles 14 above described and are secured at their lower ends to the top surface of the crossbar 15. Each of the rotor blades 17 are so located on the crossbar 15 in alternate concentric semi-circular arrangement, that when the assemblies A and B are intermeshed, as shown in FIG. 2, the rotor blades are spaced between the baffles 14. However, due to their semi-cylindrical helical form, the baffles and blades spirally intermesh with each other at some point in the assembly as the rotor blades rotate.

The baffles 14 and the rotor blades 17, as above described, are each formed in the shape shown in FIG. 10 and are preferably cut in semi-circular helical form having a height H, an internal diameter D, a wall thickness T and a width W. For instance, in cutting the four baffles 14, as seen in the plan view FIGS. 5 and 6, two baffles of different internal diameters would be required. Similarly, in cutting the six rotor blades 17, three blades of different internal diameters would be required. The baffles are cut having an internal diameter such that when axially located within the diameter of the rotor blades, they would alternate with each other radially.

The baffles and blades are of rectangular or other cross section, as required for any particular machine.

Figure 4:
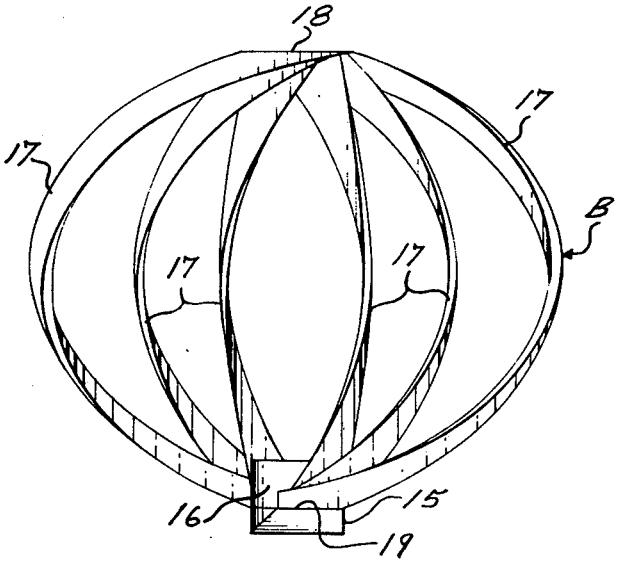
FIG. 4 is an elevational view of the rotary blade assembly only, taken from FIG. 2.

The ends of the baffles 14 and rotor blades 17 are straight and parallel with each other, as indicated at 18 and 19, particularly shown in FIG. 4, and these straight portions extend equally on either side of the axis X–Y which is normal to the axis of the drive shaft 9 to provide the overlap Z, indicated in both plan view FIGS. 5 and 6.

Figure 7:
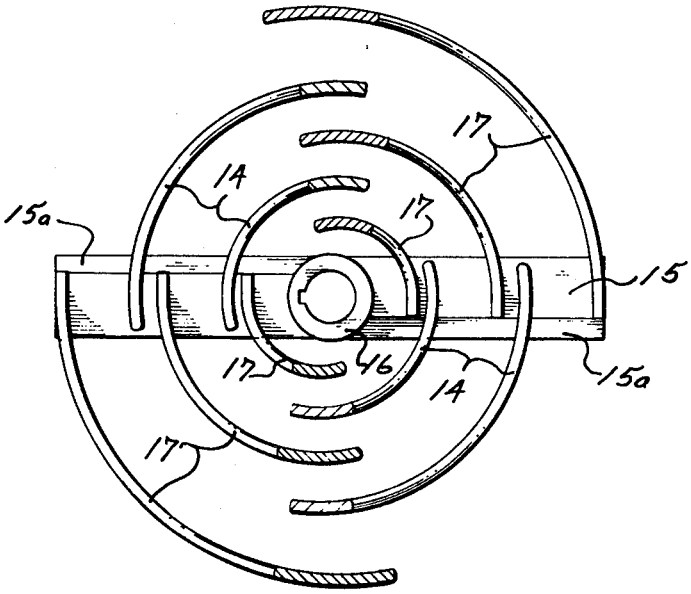
FIG. 7 is a horizontal sectional view taken on the line 7—7 of FIG. 2.

In some instances, the crossbar 15 secured on the lower end of the drive shaft 9 may have its leading edges bevelled, as shown at 15*a* in FIGS. 6 and 7 where the direction of rotation is indicated by the arrow 20.

In FIG. 8, there is shown an alternative form of rotor blade assembly in which the rotor blades 21 are straight bars projecting upwardly from the crossbar 22. The radial spacing of these blades 21 on the crossbar 22 is the same as the spacing of the anchorage of the rotor blades 17 on the crossbar 15 and the blades 21 intermesh with the baffles 14 in the baffle assembly A to provide spiral meshing in the manner previously described when the rotor blade assembly is rotated.

In FIG. 8*a*, the blades 21*a* are shown set at an angle$\alpha$. In this arrangement, the leading edge of one of the outer blades will act as a scraper, scraping material from the side walls of the tank 5. By angle mounting of the other blades in the assembly, components of radial flow of the material being mixed (either towards the shaft 9 or towards the side wall of the tank 5, or both) can be introduced to the batch, thus further reducing the time required to reach a state of batch uniformity.

In some instances, particularly in smaller sized of mixing machines, in order to facilitate addition of ingredients, it is desirable that the baffle support crossbar be located above the top lip of the tank 5. In order to accomplish this, the top ends of the baffles 14*a* are secured to the lower ends of the rods 23, as shown in FIG. 9 where the rods 23 project downwardly from the crossbar 11*a*.

While the baffle assembly A is shown having four baffles and the rotor blade assembly B is shown having six rotor blades, it is to be understood that the number of baffles and rotor blades used will depend on the size of the mixing machine and particularly on the type of material to be mixed.

In the operating of this invention, when the tank 5 is loaded with the material to be mixed and the rotor assembly B is started up by the drive mechanism 10, the material is drawn into the intermeshed assemblies A and B and is given a thorough mixing by the spiral motion of the intermeshed assemblies. During this operation, the rotor blades, both the semi-cylindrical helical form 17 or the straight form 21, continuously spirally intermesh with the stationary baffles 14 with the result that the material, in addition to its spiral movement, is continuously subject to shear along the whole height of the intermeshed baffles and rotary blades due to the continuous spiral intermesh between them. This continuous spiral shearing action on the material ensures the elimination of any possible stratification of the material.

Due to the fact that there is constant rotary and spiral intermeshing of the baffles and the rotor blades, the load on the driving mechanism is constant throughout each revolution, the mixing of the material is more uniform and can be completed in a much shorter time than has hitherto been possible.

The embodiments of the invention in which an exclusive property or privilege is claimed are defined as follows:

1. A mixing apparatus for mixing paste materials comprising a mixing tank having side walls, a bottom wall and a top wall, a drive shaft centrally positioned in the top wall of the mixing tank so that the free end of the drive shaft extends into said tank, means for rotating the said shaft, a series of fixedly mounted baffles, said baffles being mounted with the upper ends thereof at the top on the tank and the lower, free ends thereof extending downwardly from the top of the tank, said baffles being helical and of generally semi-circular form as viewed in transverse cross-section, and being disposed radially in spaced relation about the axis of the drive shaft, a rotor crossbar secured to the free end of the said drive shaft adjacent to said bottom wall of the tank and below the lower free ends of the said baffles, and a series of rotor blades secured at one end to the said crossbar, the said rotor blades being helical and of generally semi-circular form as viewed in transverse cross-section, and being disposed radially in spaced relation about the axis of the said drive shaft, the said baffles and rotor blades intermeshing with each other in radially spaced apart relationship, the said baffles and rotor blades being disposed radially about the axis of the said drive shaft in alternate semi-circular arrangement, the free ends of the baffles extending to within a short distance of the fixed ends of the rotor blades, and the free ends of the rotor blades extending to within a short distance of the fixed ends of the baffles.

2. The invention as claimed in claim 1 in which the free ends of the baffles and rotor blades, in plan view, overlap the fixed ends of adjacent baffles and rotor blades.

3. The invention as claimed in claim 2 in which the free ends of the said baffles and rotor blades extend on either side of an axis which is normal to the axis of the said drive shaft.

4. The invention as claimed in claim 1, in which the sides of greatest length of the said baffles and rotor blades are disposed vertically and parallel with the axis of the said drive shaft.

5. The invention as claimed in claim 1 in which the upper ends of the said baffles are secured to the lower end of rods depending from a crossbar located above the top edge of the said tank, and the said drive shaft has an extended length to permit the intermeshing of the baffles and rotor blades within the tank.

* * * * *